US011118427B2

(12) United States Patent
Gupta et al.

(10) Patent No.: US 11,118,427 B2
(45) Date of Patent: Sep. 14, 2021

(54) MANAGING CORROSION AND SCALE BUILDUP IN A WELLBORE

(71) Applicant: Saudi Arabian Oil Company, Dhahran (SA)

(72) Inventors: Anuj Gupta, Katy, TX (US); Sunder Ramachandran, Sugar Land, TX (US); Sebastian Csutak, Houston, TX (US)

(73) Assignee: Saudi Arabian Oil Company, Dhahran (SA)

( * ) Notice: Subject to any disclaimer, the term of this patent is extended or adjusted under 35 U.S.C. 154(b) by 146 days.

(21) Appl. No.: 16/588,861

(22) Filed: Sep. 30, 2019

(65) Prior Publication Data

US 2021/0095563 A1 Apr. 1, 2021

(51) Int. Cl.

| | |
|---|---|
| ***E21B 37/00*** | (2006.01) |
| ***E21B 47/00*** | (2012.01) |
| ***E21B 49/08*** | (2006.01) |
| *E21B 37/06* | (2006.01) |

(52) U.S. Cl.

CPC ..... *E21B 37/00* (2013.01); *E21B 47/00* (2013.01); *E21B 49/087* (2013.01); *E21B 37/06* (2013.01); *E21B 49/0875* (2020.05)

(58) Field of Classification Search

CPC ..... E21B 47/00; E21B 37/00; E21B 37/06; E21B 47/006

See application file for complete search history.

(56) References Cited

U.S. PATENT DOCUMENTS

| | | | |
|---|---|---|---|
| 4,665,981 | A | 5/1987 | Hayatdavoudi |
| 9,075,038 | B2 | 7/2015 | Tumiatti et al. |
| 2003/0071988 | A1 | 4/2003 | Smith et al. |
| 2010/0300684 | A1 | 12/2010 | Kotsonis et al. |
| 2013/0087328 | A1 | 4/2013 | Maida, Jr. et al. |

(Continued)

FOREIGN PATENT DOCUMENTS

| | | |
|---|---|---|
| WO | WO 199850680 | 11/1998 |
| WO | WO2001080043 | 10/2001 |

OTHER PUBLICATIONS

Kunz et al, "The GERG-2008 Wide-Range Equation of State for Natural Gases and Other Mixtures: An Expansion of GERG-2004," J. Chem. Eng. Data 57 : pp. 3032-3091, 2004, 60 pages.

(Continued)

*Primary Examiner* — Robert E Fuller

(74) *Attorney, Agent, or Firm* — Fish & Richardson P.C.

(57) ABSTRACT

A method of determining a risk of corrosion and scale formation of tubing in a wellbore includes receiving, from a plurality of first sensors positioned at a downhole location of a wellbore, first production stream information and receiving, from a plurality of second sensors positioned at an uphole location, second production stream information. The method also includes performing a material balance to determine a first value representing a difference between a first production steam flow rate at the downhole location and a second production stream flow rate at the uphole location. The method also includes determining a second value representing a critical metal ion concentration of the production stream and, based on a result of comparing the first value with a threshold and based on the second value, determining a third value representing a risk of corrosion and scale formation at the tubing disposed within the wellbore.

20 Claims, 3 Drawing Sheets

(56) References Cited

U.S. PATENT DOCUMENTS

| | | | |
|---|---|---|---|
| 2014/0172382 | A1 | 6/2014 | Andrews et al. |
| 2019/0292881 | A1 | 9/2019 | Zhang et al. |

OTHER PUBLICATIONS

Lemmon et al, "NIST Standard Reference Database 23: Reference Fluid Thermodynamic and Transport Properties—REFPROP," Version 9.1, National Institute of Standards and Technology, Standard Reference Data Program, Gaithersburg, 2013, 62 pages.

Wagner et al, "International Equations for the Saturation Properties of Ordinary Water Substance. Revised According to the International Temperature Scale of 1990," Addendum to J. Phys. Chem. Ref. Data 16, 893 (1987), J. Phys. Chem. Ref, Data. 22, pp 783-787, 5 pages.

PCT International Search Report and Written Opinion in International Appln. No. PCT/US2020/053430, dated Jan. 11, 2021, 14 pages.

MANAGING CORROSION AND SCALE BUILDUP IN A WELLBORE

TECHNICAL FIELD

This disclosure relates to managing tubing and wellbore production operations.

BACKGROUND OF THE DISCLOSURE

Hydrocarbons trapped in underground reservoirs are produced to the surface through wellbores drilled in the ground to contact the reservoir. Wellbores can be cased or uncased. Different types of tubing can be lowered and positioned in the wellbore. One example of such tubing is production tubing through which the hydrocarbons from the reservoirs flow to the surface. Over time, any tubing in the wellbore can experience corrosion or scale buildup which can negatively affect the wellbore's capability to produce the hydrocarbons.

SUMMARY

Implementations of the present disclosure include a method that includes receiving, from a plurality of first sensors positioned at a downhole location of a wellbore, first production stream information. The plurality of first sensors are configured to sense the first production stream information about a production stream flowing past the downhole location. The method also includes receiving, from a plurality of second sensors positioned at an uphole location with respect to the downhole location, second production stream information. The plurality of second sensors are configured to sense the second production stream information about the production stream flowing past the uphole location. The production stream flows through a tubing disposed within the wellbore. The method also includes performing, using the first production stream information and the second production stream information, a material balance to determine a first value representing a difference between a first production steam flow rate at the downhole location and a second production stream flow rate at the uphole location. The method also includes, comparing the first value with a threshold, and determining, using the second production stream information, a second value representing a critical metal ion concentration of the production stream. The method also includes, based on a result of comparing the first value with a threshold and based on the second value, determining a third value representing a risk of corrosion and scale formation at the tubing disposed within the wellbore.

In some implementations, the downhole location includes a reservoir location at which hydrocarbons entrapped in a subterranean zone enter the tubing.

In some implementations, the uphole location includes a surface of the wellbore.

In some implementations, the first production steam flow rate includes a first water vapor production rate and the second production stream flowrate includes a second water vapor production rate, where determining the first value includes 1) determining the first water vapor production rate at the downhole location and the second water vapor production rate at the uphole location and 2) determining, by subtraction, a difference between the first water vapor production rate and the second water vapor production rate. In some implementations, the first production stream information includes a pressure and a first gas production rate and the second production stream information includes a temperature, a water production rate, and a second gas production rate. Determining the first water vapor production rate includes determining, based the pressure and the first gas production rate, the first water vapor production rate, where determining the second water vapor production rate includes determining, based on the temperature, the water production rate, and the second gas production rate, the second water vapor production rate. In some implementations, the threshold represents a water vapor production rate value, where comparing the first value with the threshold includes determining that a difference between the first value and the water vapor production rate value is indicative of fluid accumulating at the wellbore. In some implementations, the threshold represents a water vapor production rate value, where comparing the first value with the threshold includes determining that a difference between the first value and the water vapor production rate value is indicative of excess fluid being produced at the wellbore.

In some implementations, determining the second value includes acidifying a sample of the production stream at the uphole location and measuring, from the sample, at least one of a critical iron concentration and a critical manganese concentration of the sample.

In some implementations, determining the second value includes determining a critical iron concentration of the production stream based on a depth of the wellbore.

In some implementations, the method further includes, after determining the second value, comparing the second value with a second threshold. Determining the third value includes, based on the result of comparing the first value with the threshold and based on a second result of comparing the second value with the second threshold, determining the third value representing the risk of corrosion and scale formation at the tubing.

In some implementations, the method further includes receiving, from a plurality of third sensors positioned at a mid-wellbore location between the downhole location and the uphole location, third production stream information. The plurality of third sensors are configured to sense the third production stream information about the production stream flowing past the mid-wellbore location, where performing the material balance includes performing, using the third production stream information and at least one of the first production stream information and the second production stream information, a second material balance to determine a fourth value. In some implementations, the method further includes analyzing, based on the third production stream information and at least one of the first production stream information and the second production stream information, the production stream to determine a fifth value representing a flow regime of the production stream. Determining the risk of corrosion and scale formation at the wellbore includes determining the third value based on the first value, the second value, and the fifth value. In some implementations, determining the fifth value includes determining, based on a fluid density difference, a gas velocity, and interfacial tension between gas and liquids in the tubing, a flow regime.

In some implementations, the method further includes notifying a user about the third value representing a risk of corrosion and scale formation at the tubing disposed within the wellbore.

In some implementations, the method further includes determining, using the second production stream information, a critical corrosion rate of the production stream, Determining the third value includes, based on a result of comparing the first value with the threshold, based on the second value, and based on the critical corrosion rate, determining the third value.

Implementations of the present disclosure also include a system that includes at least one processing device and a memory communicatively coupled to the at least one processing device. The memory stores instructions which, when executed, cause the at least one processing device to perform operations that include receiving, from a plurality of first sensors positioned at a downhole location of a wellbore, first production stream information. The plurality of first sensors are configured to sense the first production stream information about a production stream flowing past the downhole location. The operations also include receiving, from a plurality of second sensors positioned at an uphole location with respect to the downhole location, second production stream information. The plurality of second sensors are configured to sense the second production stream information about the production stream flowing past the uphole location. The production stream flows through a tubing disposed within the wellbore. The operations also include performing, using the first production stream information and the second production stream information, a material balance to determine a first value representing a difference between a first production steam flow rate at the downhole location and a second production stream flow rate at the uphole location. The operations also include, comparing the first value with a threshold, and determining, using the second production stream information, a second value representing a critical metal ion concentration of the production stream. The operations also include, based on a result of comparing the first value with a threshold and based on the second value, determining a third value representing a risk of corrosion and scale formation at the tubing disposed within the wellbore.

In some implementations, the first production steam flow rate includes a first water vapor production rate and the second production stream flowrate includes a second water vapor production rate. Determining the first value includes 1) determining the first water vapor production rate at the downhole location and the second water vapor production rate at the uphole location and 2) determining, by subtraction, a difference between the first water vapor production rate and the second water vapor production rate.

In some implementations, the first production stream information includes a pressure and a first gas production rate and the second production stream information includes a temperature, a water production rate, and a second gas production rate. Determining the first water vapor production rate includes determining, based the pressure and the first gas production rate, the first water vapor production rate, and determining the second water vapor production rate includes determining, based on the temperature, the water production rate, and the second gas production rate, the second water vapor production rate.

Implementations of the present disclosure also include a system that includes a plurality of first sensors positioned at a downhole location of a wellbore. The plurality of first sensors are configured to sense first production stream information about a production stream flowing past the downhole location. The system also includes a plurality of second sensors positioned at an uphole location of the wellbore. The plurality of second sensors are configured to sense second production stream information about the production stream flowing past the downhole location. The system also includes at least one processing device and a memory communicatively coupled to the at least one processing device. The memory stores instructions which, when executed, cause the at least one processing device to perform operations that include receiving, from the plurality of first sensors, the first production stream information. The operations also include receiving, from the plurality of second sensors, the second production stream information. The production stream flows through a tubing disposed within the wellbore. The operations also include performing, using the first production stream information and the second production stream information, a material balance to determine a first value representing a difference between a first production steam flow rate at the downhole location and a second production stream flow rate at the uphole location. The operations also includes comparing the first value with a threshold and determining, using the second production stream information, a second value representing a critical metal ion concentration of the production stream. The operations also include, bases on a result of comparing the first value with a threshold and based on the second value, determining a third value representing a risk of corrosion and scale formation at the tubing disposed within the wellbore.

In some implementations, the first production steam flow rate includes a first water vapor production rate and the second production stream flowrate includes a second water vapor production rate, where determining the first value includes 1) determining the first water vapor production rate at the downhole location and the second water vapor production rate at the uphole location and 2) determining, by subtraction, a difference between the first water vapor production rate and the second water vapor production rate.

DETAILED DESCRIPTION OF THE DISCLOSURE

Fluids such as water and hydrocarbons are produced through wellbore tubing (for example, production tubing in the wellbore). Such fluids along with the conditions of the wellbore contribute to corrosion and scale buildup on the tubing. Unchecked scale buildup can lead to production loss and corrosion can result in the failing of the tubing. Determining a risk of corrosion and scale buildup in the tubing followed by needed intervention can prevent the failure of the tubing.

The present disclosure relates to sampling a production stream flowing through a tubing of a wellbore to determine a risk of corrosion, scale formation (for example, iron sulfide scale formation), or other properties that compromise the integrity of the tubing. Implementations of the present disclosure include a risk detection system that is configured to receive information from sensors at different location of the tubing and to perform a volume and material balance with the information. The material balance is used to estimate water content, liquid hydrocarbon content, and water-gas ratio and condensate-gas ratio at various locations in the production tubing and wellbore. Some of the sensors can sense physical properties of the production stream such as pressure, temperature, and flow rates. Other sensors can also sense other properties of the production stream such as composition, density, viscosity, sound speed, optical transmittance, and refractive index.

Implementations of the present disclosure may provide one or more of the following advantages. Corrosion and scale buildup can be detected on the tubing without using sensors that directly measure corrosion or scale formation. The present system can rank various wells with regards to their risk of corrosion and scale formation and therefore identify wells at highest risk in order to prioritize well intervention. The present system can determine the location of the scale formation or corrosion along the tubing without the need of deploying sensors that move through the tubing or without using sensors that directly measure corrosion or scale formation.

Figure 1:
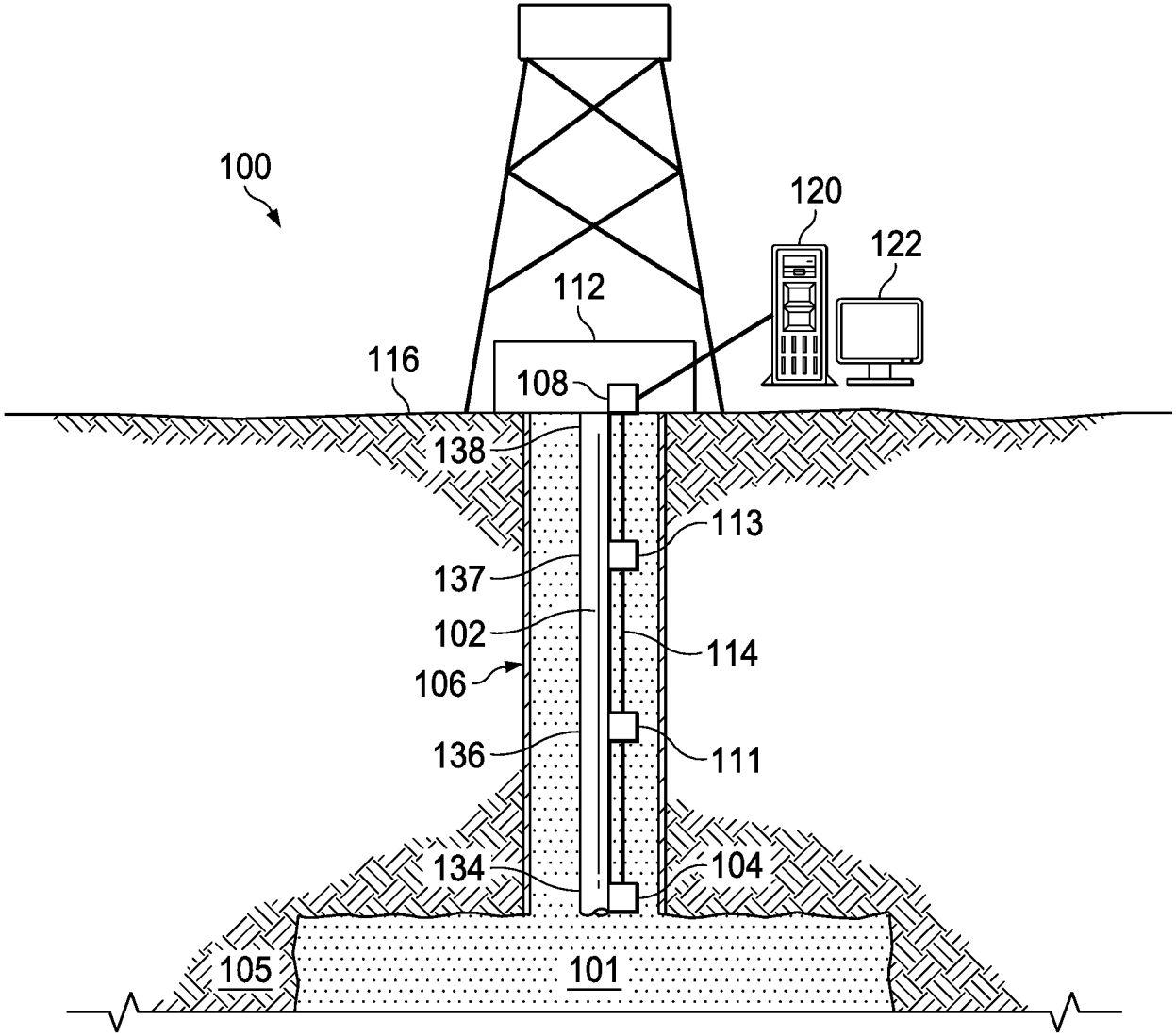
FIG. 1 is a cross sectional, schematic view of wellbore production system that includes a corrosion and scale buildup risk detection system.

FIG. 1 illustrates a cross sectional, schematic view of a wellbore production system that includes a corrosion and scale buildup risk detection system 100 deployed in a wellbore. The wellbore production system includes a tubing 102 deployed within a wellbore 106 formed in a geologic formation 105. The risk detection system 100 includes at least one processing device 122 (for example, a computer system including one or more processors) and a memory 120 at or near the surface 116 of the wellbore 106. For example, the processing device 122 (and the memory 120) can be placed in the wellbore 106, near the surface, at the wellhead of the wellbore, or in a facility at the surface of the wellbore. The tubing 102 includes tubing and equipment or tools installed within the wellbore 106 that are susceptible to corrosion and scale buildup. The tubing 102 is susceptible to corrosion and scale buildup because of fluids (for example, water and hydrocarbons) that flow through the tubing. The risk detection system 100 also includes multiple first sensors 104 (for example, a sensor box housing multiple sensors) at a downhole location 134 within the wellbore, and multiple second sensors 108 at an uphole location 138 within the wellbore. The downhole location 134 can be a location at a reservoir 101 from which hydrocarbons entrapped in a subterranean zone enter the tubing 102. For example, multiple first sensors 104 can be secured to an inlet of the tubing 102 through which hydrocarbons enter the tubing 102. The uphole location 138 is a surface location such as a location at a wellhead 112. For example, multiple second sensors 108 can be secured to an interior channel of the wellhead through which the hydrocarbons exit the tubing 102 or the wellbore 106. Multiple sensors 104 and 108 can sense, at their respective locations, production stream information from a production stream flowing through the tubing 102. The production stream flowing though the tubing 102 can be a stream of hydrocarbons and can include water and water vapor. For example, the production stream can be a gas having carbon dioxide or hydrogen sulfide (or both) above 0.1 mole percent.

The risk detection system 100 can also include multiple sensors 111 disposed in a first mid-wellbore location 136, multiple sensors 113 disposed in a second mid-wellbore location 137, and more sensors disposed between sensors 104 and sensors 108. The third sensors 111 and the fourth sensors 113 can also sense production stream information about the production stream flowing through the tubing 102. For example, the third and fourth sensors 111 and 113 can be disposed inside the tubing 102 to sense the production stream flowing through the tubing 102. The fourth sensors 113 can be disposed between the second sensors 108 and the third sensors 111.

The processing device 122 can be communicatively coupled to the sensors 104, 108, 111, and 113. The sensors transmit (for example, through wired or wireless connections), to the processing device 122, the production stream information sensed at their respective locations. For example, the first sensors 104 sense first production stream information about the production stream flowing past the downhole location 134. The second sensors 108 sense second production stream information about the production stream flowing past the uphole location 138. The third sensors 111 sense third production stream information about the production stream flowing past the first mid-wellbore location 136. The fourth sensors 113 sense fourth production stream information about the production stream flowing past the second mid-wellbore location 137 between the third sensors 111 and the second sensors 108. The production stream information that each multiple sensors sense include, but is not limited to: pressure of the production stream, temperature of the production stream, flow rate of the production stream (for example, hydrocarbon gas product flow rate, oil production flow rate, and water production flow rate), composition of the production stream (for example, ionic composition of water), density of the production stream, viscosity of the production stream, sound speed in the production stream, optical transmittance in the productions steam, and refractive index in the production stream. The properties at the four different locations will be different due to change in the pressure and temperature with depth. The composition of oil, gas and water will change with changes in pressure and temperature. The density of each water, oil and gas phase will also change with changes in composition and change in pressure & temperature. Change in ionic composition and pH of water many cause precipitation of solids (scale) or dissolution of solids and metal from tubing (corrosion). Change in pH and ionic composition of water between different location allows determination of corrosion & scaling between these locations.

The sensors 104, 108, 111, and 113 can include one or more of the following devices. For example, a multiphase meter can be used to sense or measure hydrocarbon gas, oil, and water production rates. A multiphase meter that can be used is the Roxar Multiphase meter by Emerson Process Management located in St. Louis, Mo. In some cases, the wet gas meter such as the Roxar Wet-gas meter also by Emerson Process Management can be used. The output of such devices can be measured to calculate hydrocarbon gas, oil, and water production rates. Devices such as thermocouples, fiber optic device, or electrical resistance devices can be used to sense temperatures of the production stream. Piezo resistive silicon devices can be used to sense pressures of the production stream. Additionally, metal ion concentrations in the produced stream can be measured using inductively coupled X-ray atomic emission spectroscopy. Electron spin resonance can also be used with inline measurements to detect iron and manganese concentrations in the production stream. Changes in ionic concentration of water phase in material balance calculations allows determination of amount of corrosion or scaling between the sensor locations. The composition of the hydrocarbon production stream can be measured using gas chromatography or other suitable instrumentation. This allows determination of locations where a liquid hydrocarbon phase may condense from otherwise gas phase. Such liquid hydrocarbon film coating on metal tubing may prevent corrosion or scaling in locations where it may occur in the absence of the liquid hydrocarbon film. The choice of a sensor depends on the location (that is, the depth) at which the sensor is installed.

Figure 2:
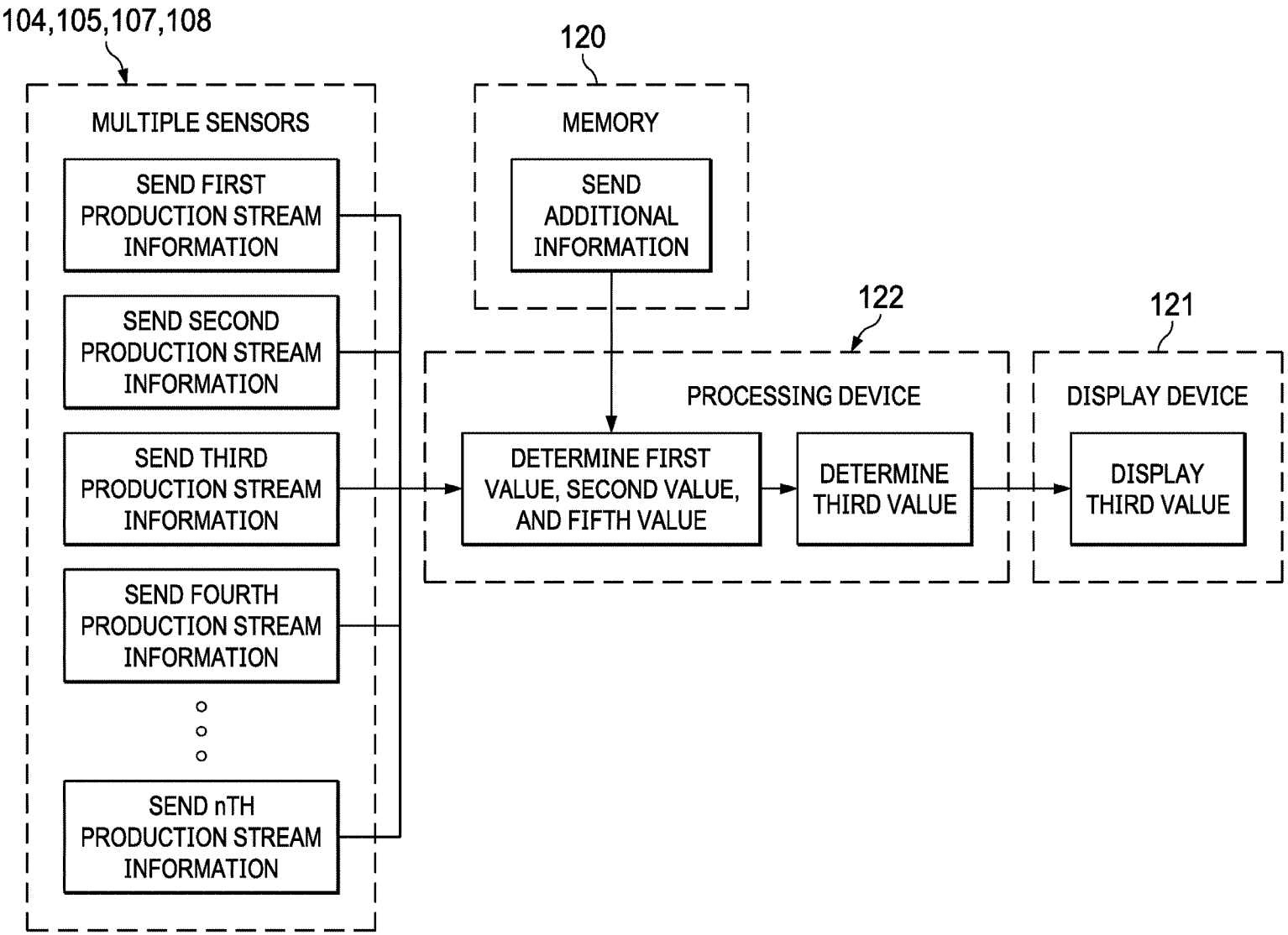
FIG. 2 is a block diagram of the corrosion and scale buildup risk detection system according to implementations of the present disclosure.

Referring also to FIG. 2, the processing device 122 performs a material balance or mass and volume balance using at least some of the production stream information received from the sensors 104, 108, 111, and 113. For example, the processing device 122 can use the first production stream information and the second production stream information to perform the material balance. The material balance accounts for fluids and solids entering the tubing 102 at the downhole location 134 and fluids leaving the tubing 102 at the uphole location 138 to determine if fluids and solids are accumulating in the tubing or the wellbore, or are being produced by removal from the tubing in the wellbore 106. For example, it may be determined that less water in being produced compared to the amount of water entering the well. Such excess water, along with the dissolved ions may form a film on the tubing for certain depth and may accumulate at the deepest part of the tubing, as it is the densest fluid in the wellbore. At certain conditions of pressure, temperature, ionic composition and pH, dissolved ions in water may precipitate on the adjacent tubing of the wellbore to cause scale build-up. At certain other conditions of pressure, temperature, ionic composition and pH, ions from tubing may dissolve in water to cause corrosion in adjacent tubing of the wellbore. For a certain combinations of pressure and temperature, hydrocarbon liquids (condensate) may condense from the gas phase causing a coating of liquid hydrocarbon on the tubing. Depending on the composition of liquid hydrocarbon, such condensate coating may prevent corrosion or scale build-up. By determining if fluids are accumulating or being produced in the wellbore 106, a risk and susceptibility of the tubing for corrosion and scale formation can be determined or measured. For example, if an excess amount of fluid (for example, water) accumulates in the tubing 102, then the tubing 102 is more susceptible to corrosion or may already have corrosion. If all of the water entering the tubing from the reservoir is being produced from the wellbore 106, the tubing 102 can be less susceptible to corrosion and scale formation. If excess of liquid hydrocarbon (condensate) is accumulating in the tubing 106, it may protect the tubing from corrosion and scale formation.

For example, if a flow rate at the four locations is the same, then the wellbore is likely free of corrosion and scale buildup. If the mass flow rate at the four locations is not the same, then the wellbore likely has corrosion and scale buildup where water is accumulating. Similarly, if the metal ion concentration at the four locations is the same, then the wellbore is likely free of corrosion and scale buildup. If the metal ion concentration at the four locations is not the same, then the opposite is likely true. Thus, the mass balance and material balance test can be a comparison at each of the four locations.

To perform the material or mass balance tests, processing device 122 first receives production stream information form the multiple sensors 104, 108, 111, and 113 to determine a first production stream flowrate at the downhole location 134 and a second production stream flowrate at the uphole location 138. The respective production stream flowrates can be water vapor production rates or other fluid production rates. To determine the first water vapor production rate at the downhole location 134, processing device 122 can, based on a pressure and a hydrocarbon gas production rate received from multiple first sensors 104, determine the water vapor production rate at the downhole location 134. To determine the second water vapor production rate, processing device 122 can, based on a temperature, a water production rate, and a second hydrocarbon gas production rate received from multiple second sensors 108, determine the water vapor production rate at the uphole location 138.

To determine the first water vapor production rate, the processing device 122 can use information representing pressure and a hydrocarbon gas production rate (for example, gas flow rate) received from the multiple first sensors 104. The pressure can be a bottom hole pressure of the production stream at the entrance of the tubing 102. The processing device 122 can determine the first water vapor production rate based on the hydrocarbon gas production rate and on a mole fraction of water in the gas phase. To determine the mole fraction of water in the gas phase, the processing device 122 can use the following equation:

$$y_w = p_{vw}/p_{bh}$$

in which $y_w$ is the mole fraction of water in the gas phase, $p_{vw}$ is the vapor pressure of pure water (obtained using the pressure and temperature received from sensors 104 and an appropriate equation for water saturation properties), and $p_{bh}$ is the bottom hole pressure in the reservoir received from sensors 104. Upon determining the mole fraction of water in the gas phase, the processing device 122 can calculate, using the mole fraction of water and the hydrocarbon gas production rate, the water vapor flow rate at the downhole location. Water flow rate can be determined from gas flow-rates using the following equation:

$$q_w(\text{bbl/d}) = q_g(\text{MMSCF/d}) * y_w * C,$$

where, $q_w$ is water vapor flow rate in barrels per day, $q_g$ is gas flow rate in Million cubic feet per day, and C is a unit conversion factor.

To determine the second water vapor production rate at the uphole location 138, the processing device 122 can use a pressure and temperature, and a hydrocarbon gas production rate received from the second sensors 108. For example, the second production stream information includes a pressure and temperature of the production stream at the outlet of the tubing 102 where the second sensors 108 are disposed. The second water vapor production rate can be an amount of water vapor exciting the tubing 102. To determine the water vapor flowrate at the uphole location 138, the mole fraction of water vapor in the gas stream is determined using the following equation:

$$y_w = p_{vw}/p_{108},$$

in which $y_w$ is the mole fraction of water in the gas phase, $p_{vw}$ is the vapor pressure of pure water (obtained using the pressure and temperature received from sensors 108), and $p_{108}$ is the tubing pressure from sensors 108. Water vapor flow-rate is obtained from the equation listed in [0017]. The difference between the two rates allows calculation of liquid water rate some of which may be accumulated in the tubing if not produced to the surface.

In some implementations and upon determining the first water vapor production rate and the second water vapor production rate, the processing device 122 can perform the material balance. To perform the material balance, the processing device 122 can determine, by subtraction, a first value which represents a difference between the first water vapor production rate and the second water vapor production rate. Thus, to determine if fluids are accumulating or being produced in the wellbore 106, the risk detection system 100 can determine, using material balance and based on the information received from the sensors, the first value. The first value represents a difference between the first production steam flow rate (for example, the first water vapor production rate) at the downhole location 134 and the second production stream flow rate (for example, the second water vapor production rate) at the uphole location 138. The difference can be determined by subtracting the first water vapor production rate from the second water vapor production rate.

The processing device 122 can also determine, based on the information received from the multiple second sensors 108, a second value representing a critical metal ion concentration of the production stream (for example, an iron concentration and a manganese concentration of the production stream). To determine the second value representing the critical metal ion concentration in the production stream, multiple methods can be used. First, the processing device 122 receives, from multiple second sensors 108 at the surface 116 of the wellbore 106, a value representing an ion concentration of the production stream. For example, multiple second sensors 108 can help determine at least one of an iron concentration and a manganese concentration from a water sample at the surface 116 of the wellbore 106. One method to determine iron or manganese concentrations from water samples is to acidify the sample and use inductively coupled X-ray atomic emission spectroscopy to measure the iron concentration. Another method includes obtaining inline measurements for iron and manganese using electron spin resonance. With the measured pressure and temperature at locations in the surface 116, pressure and temperature gradients are used to calculate pressure and temperature at various depths of the wellbore 106. Such plots of pressure and temperature with depth are referred to herein as "pressure profile" and "temperature profile," respectively. Pressure and temperature at each depth are used in thermodynamic calculations to determine the "critical metal ion concentration" that can be dissolved in aqueous phase at those conditions. Comparing actual metal ion concentration to "critical ion concentration" helps determine depth at which scale may form. The amount of iron required to precipitate iron sulfide scale throughout the profile can be calculated using information on the solubility product of different iron sulfides. In some examples, if the calculated iron concentration in the produced water is measured by the processing device 122 to be 10 mg/l, a portion of the wellbore 106 deeper than 5000 feet would be at risk of scaling and the interval shallower than 5000 feet would be at the risk of corrosion.

The processing device 122 can also determine a critical corrosion rate of the production stream. For example, a critical corrosion rate can be a corrosion rate at which iron sulfide precipitation can occur in the tubing 106. The amount of iron released in the tubing 106 is indicative of corrosion in the tubing. The composition of gas and oil being produced is needed for some risk assessments. The composition may be measured using gas chromatography or other suitable instrumentation. If a very small critical sour corrosion rate is needed to cause iron sulfide precipitation, the tubing 106 is at risk for iron sulfide precipitation.

To determine if the tubing 102 is at risk of corrosion and scale buildup, the processing device 122 can compare the difference between the first production stream flow rate and the second production stream flow rate, that is, the first value, to a threshold. As described earlier, to determine such difference, the processing device 122 determines, by subtraction, the difference between the first and second production stream flowrates (for example, the difference between the first and second water vapor production rates). If the difference between the first and second water vapor production rates is above or below the threshold (for example, 10% above or below), the well is deemed a risky well. The threshold can represent a water vapor production rate value. For example, the threshold can indicate a normal amount of water vapor expected to be produced by condensation or a normal amount of water vapor expected to be accumulated in the wellbore. The higher the percentage, the higher the risk of corrosion or scale formation or both. The risk of corrosion can be represented by a third value such as a value from 1 to 10, with 1 representing low risk and 10 representing high risk. Such relative ranking among various wells from lowest to highest risk can allow prioritization of well intervention for wells with highest risk of corrosion or scaling.

In some examples, if the difference between the production stream flow rates is within a certain percentage of the amount of water coming from the reservoir 101 with gas, then most of the water at the surface 116 is considered coming from the saturated gas from the reservoir 101 and the well is considered to be at a steady state that has less risk. If the amount of water produced in the wellbore 106 is significantly more than the water that is carried by saturated gas from the reservoir 101, then large amounts of water is considered being produced from the reservoir 101 as free water. In such scenario, the tubing 102 is considered to be likely at risk of corrosion and scale formation. If the amount of water produced is significantly less than the water that is carried by the saturated gas from the reservoir 101, then fresh water is considered to be accumulating within the wellbore 106. In such scenario, the tubing 102 is likely to be at risk due to both corrosion and scale formation.

Additionally, as described earlier, the second value representing a critical metal ion concentration of the production stream at the wellhead can also influence the risk of corrosion and scale buildup. Thus, based on the result of comparing the first value to the threshold and on the result of comparing the second value to a second threshold, the third value representing the risk of corrosion and scale formation at the tubing 102 can be determined. The first and second thresholds can include normalized values or percentages. As shown in FIG. 2, the third value (the risk value) can be displayed in a display device 121 to notify a user about the risk of the tubing 102. Additionally, the memory 120 can have additional information such as equations, tables, and instructions for the processing device 122 to use to determine the first and second values. The second threshold can include a critical ion concentration threshold. For example, the second threshold can be a value that represents a critical iron concentration or critical manganese concentration needed to cause iron sulfide scale precipitation. When the second value is the same as or above the threshold, the tubing 102 is at risk of scale buildup. Based on the results of comparing the first value to the threshold and the second value to the second threshold, the processing device 122 can determine the third value. For example, if the first value is certain percentage above or below the threshold, the tubing can have a high risk of corrosion and scale buildup. If the second value is certain percentage above the second threshold, the tubing can have a higher risk of corrosion and scale buildup. The risk detection system 100 can determine the third value based only on the result of comparing the first value to the threshold, or based on the two results of comparing the first value with the threshold and comparing the second value with the second threshold. In some implementations, as further described in detail later, a fifth value representing a flow regime of the production stream can be determined to help determine the third value.

The processing device 122 can perform more than one material balance to determine areas of the tubing 102 that may be at more risk of corrosion and scale formation than other areas. For example, the processing device 122 can use the third production stream information received from multiple third sensors 111 and the first production stream information received from multiple first sensors 104 to determine a fourth value representing a second difference between the production stream flow rates at the area of the tubing 104 between the multiple first sensors 104 and the multiple third sensors 111. Thus, the processing device 122 can determine an amount of fluids being accumulated or over-produced at different areas of the tubing 102. With such information, the processing device 122 can indicate what areas of the tubing 102 are more susceptible to corrosion and risk formation.

Additionally, the processing device 122 can analyze the information received from multiple sensors 104, 108, 111, and 113 to determine a fifth value representing a flow regime of the production stream at different location of the tubing 102. The flow regime is determined based on density difference and interfacial tension between gas and liquids, and, gas velocity that is determined by the total gas flow rate and the cross-sectional area of the tubing available for the flow of gas. Flow regime determines if the liquids in the production stream can be produced to the surface or if the liquid will accumulate in the tubing thus impacting the risk of corrosion and/or scale formation. In some implementations, metal ion concentration is compared to the equilibrium concentration at the temperature and pressure of the water. A high metal ion concentration indicates scale formation. A low metal ion concentration indicates risk of corrosion.

Figure 3:
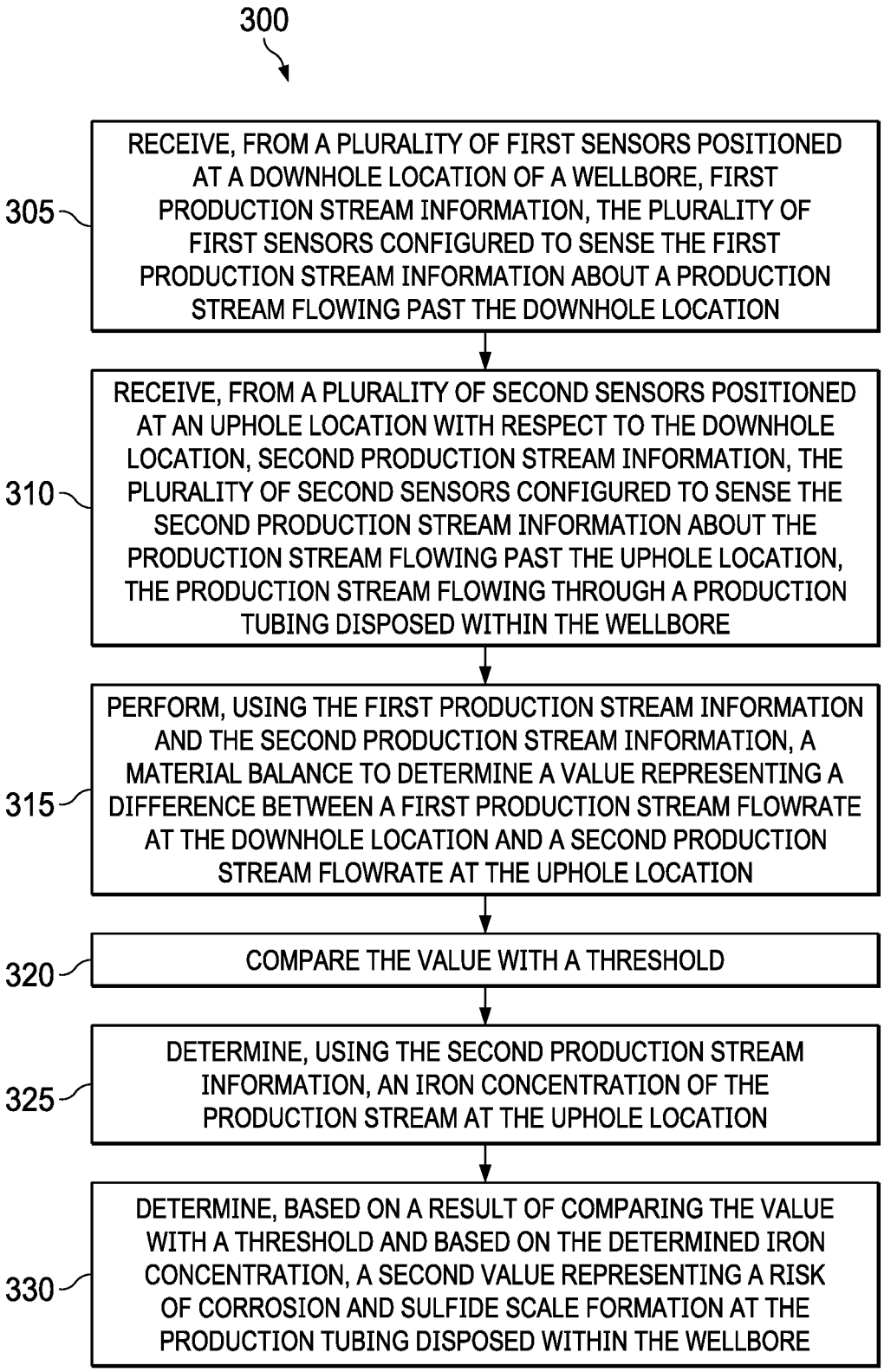
FIG. 3 is a flow chart of an example method of determining a risk of corrosion and scale formation according to implementations of the present disclosure.

FIG. 3 shows a flowchart of an example method 300 of determining the risk of corrosion and scale buildup of the tubing 102. The method 300 includes receiving, from multiple first sensors positioned at a downhole location of a wellbore, first production stream information, where multiple first sensors are configured to sense the first production stream information about a production stream flowing past the downhole location (305). The method also includes receiving, from multiple second sensors positioned at an uphole location with respect to the downhole location, second production stream information, where multiple second sensors are configured to sense the second production stream information about the production stream flowing past the uphole location and the production stream flows through a tubing disposed within the wellbore (310). The method also includes performing, using the first production stream information and the second production stream information, a material balance to determine a first value representing a difference between a first production steam flow rate at the downhole location and a second production stream flow rate at the uphole location (315). The method also includes comparing the first value with a threshold (320). The method also includes determining, using the second production stream information, a second value representing a metal ion concentration of the production stream at the uphole location (325). The method also includes, based on a result of comparing the first value with a threshold and based on the second value, determining a third value representing a risk of corrosion and scale formation at the tubing disposed within the wellbore (330).

Although the present detailed description contains many specific details for purposes of illustration, it is understood that one of ordinary skill in the art will appreciate that many examples, variations and alterations to the following details are within the scope and spirit of the disclosure. Accordingly, the example implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Ranges may be expressed in the present disclosure as from about one particular value, or to about another particular value or a combination of them. When such a range is expressed, it is to be understood that another implementation is from the one particular value or to the other particular value, along with all combinations within said range or a combination of them.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

That which is claimed is:

1. A method comprising:

receiving, from a plurality of first sensors positioned at a downhole location of a wellbore, first production stream information, the plurality of first sensors configured to sense the first production stream information about a production stream flowing past the downhole location;

receiving, from a plurality of second sensors positioned at an uphole location with respect to the downhole location, second production stream information, the plurality of second sensors configured to sense the second production stream information about the production stream flowing past the uphole location, the production stream flowing through a tubing disposed within the wellbore;

performing, using the first production stream information and the second production stream information, a material balance to determine a first value representing a difference between a first production stream flow rate at the downhole location and a second production stream flow rate at the uphole location;

comparing the first value with a threshold;

determining, using the second production stream information, a second value representing a critical metal ion concentration of the production stream; and based on a result of comparing the first value with a threshold and based on the second value, determining a third value representing a risk of corrosion and scale formation at the tubing disposed within the wellbore.

2. The method of claim 1, wherein the downhole location comprises a reservoir location at which hydrocarbons entrapped in a subterranean zone enter the tubing.

3. The method of claim 1, wherein the uphole location comprises a surface of the wellbore.

4. The method of claim 1, wherein the first production stream flow rate comprises a first water vapor production rate and the second production stream flowrate comprises a second water vapor production rate, and wherein determining the first value comprises 1) determining the first water vapor production rate at the downhole location and the second water vapor production rate at the uphole location and 2) determining, by subtraction, a difference between the first water vapor production rate and the second water vapor production rate.

5. The method of claim 4, wherein the first production stream information comprises a pressure and a first gas production rate and the second production stream information comprises a temperature, a water production rate, and a second gas production rate, and wherein the first water vapor production rate is determined based on the pressure and the first gas production rate, and wherein the second water vapor production rate is determined based on the temperature, the water production rate, and the second gas production rate.

6. The method of claim 4, wherein the threshold represents a water vapor production rate value, and wherein comparing the first value with the threshold comprises determining that a difference between the first value and the water vapor production rate value is indicative of fluid accumulating in the wellbore.

7. The method of claim 4, wherein the threshold represents a water vapor production rate value, and wherein comparing the first value with the threshold comprises determining that a difference between the first value and the water vapor production rate value is indicative of excess fluid being produced at the wellbore.

8. The method of claim 1, wherein determining the second value comprises acidifying a sample of the production stream at the uphole location and measuring, from the sample, at least one of a critical iron concentration and a critical manganese concentration of the sample.

9. The method of claim 1, wherein determining the second value comprises determining a critical iron concentration of the production stream based on a depth of the wellbore.

10. The method of claim 1, further comprising, after determining the second value, comparing the second value with a second threshold, and wherein determining the third value comprises, based on the result of comparing the first value with the threshold and based on a second result of comparing the second value with the second threshold, determining the third value representing the risk of corrosion and scale formation at the tubing.

11. The method of claim 1, further comprising receiving, from a plurality of third sensors positioned at a mid-wellbore location between the downhole location and the uphole location, third production stream information, the plurality of third sensors configured to sense the third production stream information about the production stream flowing past the mid-wellbore location, and wherein performing the material balance comprises performing, using the third production stream information and at least one of the first production stream information and the second production stream information, a second material balance to determine a fourth value.

12. The method of claim 11, further comprising analyzing the production stream based on the third production stream information and at least one of the first production stream information and the second production stream information to determine a fifth value representing a flow regime of the production stream, and wherein determining the risk of corrosion and scale formation at the wellbore comprises determining the third value based on the first value, the second value, and the fifth value.

13. The method of claim 12, wherein determining the fifth value comprises determining a flow regime based on a fluid density difference, a gas velocity, and interfacial tension between gas and liquids in the tubing.

14. The method of claim 1, further comprising notifying a user about the third value representing a risk of corrosion and scale formation at the tubing disposed within the wellbore.

15. The method of claim 1, further comprising determining a critical corrosion rate of the production stream using the second production stream information, and wherein the third value is determined based on a result of comparing the first value with the threshold, based on the second value, and based on the critical corrosion rate.

16. A system comprising:

at least one processing device; and a memory communicatively coupled to the at least one processing device, the memory storing instructions which, when executed, cause the at least one processing device to perform operations comprising:

receiving, from a plurality of first sensors positioned at a downhole location of a wellbore, first production stream information, the plurality of first sensors configured to sense the first production stream information about a production stream flowing past the downhole location;

receiving, from a plurality of second sensors positioned at an uphole location with respect to the downhole location, second production stream information, the plurality of second sensors configured to sense the second production stream information about the production stream flowing past the uphole location, the production stream flowing through a tubing disposed within the wellbore;

performing, using the first production stream information and the second production stream information, a material balance to determine a first value representing a difference between a first production stream flow rate at the downhole location and a second production stream flow rate at the uphole location;

comparing the first value with a threshold;

determining, using the second production stream information, a second value representing a critical metal ion concentration of the production stream; and based on a result of comparing the first value with a threshold and based on the second value, determining a third value representing a risk of corrosion and scale formation at the tubing disposed within the wellbore.

17. The system of claim 16, wherein the first production stream flow rate comprises a first water vapor production rate and the second production stream flowrate comprises a second water vapor production rate, and wherein determining the first value comprises 1) determining the first water vapor production rate at the downhole location and the second water vapor production rate at the uphole location and 2) determining, by subtraction, a difference between the first water vapor production rate and the second water vapor production rate.

18. The system of claim 16, wherein the first production stream information comprises a pressure and a first gas production rate and the second production stream information comprises a temperature, a water production rate, and a second gas production rate, and wherein the first water vapor production rate is determined based on the pressure and the first gas production rate, and wherein the second water vapor production rate is determined based on the temperature, the water production rate, and the second gas production rate.

19. A system comprising:

a plurality of first sensors positioned at a downhole location of a wellbore, the plurality of first sensors configured to sense first production stream information about a production stream flowing past the downhole location;

a plurality of second sensors positioned at an uphole location of the wellbore, the plurality of second sensors configured to sense second production stream information about the production stream flowing past the downhole location;

at least one processing device; and a memory communicatively coupled to the at least one processing device, the memory storing instructions which, when executed, cause the at least one processing device to perform operations comprising:

receiving, from the plurality of first sensors, the first production stream information;

receiving, from the plurality of second sensors, the second production stream information, the production stream flowing through a tubing disposed within the wellbore;

performing, using the first production stream information and the second production stream information, a material balance to determine a first value representing a difference between a first production stream flow rate at the downhole location and a second production stream flow rate at the uphole location;

comparing the first value with a threshold;

determining, using the second production stream information, a second value representing a critical metal ion concentration of the production stream; and based on a result of comparing the first value with a threshold and based on the second value, determining a third value representing a risk of corrosion and scale formation at the tubing disposed within the wellbore.

20. The system of claim 19, wherein the first production stream flow rate comprises a first water vapor production rate and the second production stream flowrate comprises a second water vapor production rate, and wherein determining the first value comprises 1) determining the first water vapor production rate at the downhole location and the second water vapor production rate at the uphole location and 2) determining, by subtraction, a difference between the first water vapor production rate and the second water vapor production rate.

* * * * *